US006868978B2

(12) United States Patent
Amschlinger et al.

(10) Patent No.: US 6,868,978 B2
(45) Date of Patent: Mar. 22, 2005

(54) CLOSING CAP FOR INFUSION AND TRANSFUSION BOTTLES

(75) Inventors: Roland Amschlinger, Karlsbad-Ittersbach (DE); Udo Bächler, Karlsbad-Ittersbach (DE)

(73) Assignee: Helvoet Pharma Belgium N.V., Alken (BE)

( * ) Notice: Subject to any disclaimer, the term of this patent is extended or adjusted under 35 U.S.C. 154(b) by 0 days.

(21) Appl. No.: 10/204,189

(22) PCT Filed: Jan. 13, 2001

(86) PCT No.: PCT/EP01/00376

§ 371 (c)(1),
(2), (4) Date: Aug. 16, 2002

(87) PCT Pub. No.: WO01/60699

PCT Pub. Date: Aug. 23, 2001

(65) Prior Publication Data

US 2003/0029828 A1 Feb. 13, 2003

(30) Foreign Application Priority Data

Feb. 18, 2000 (DE) ..... 100 07 367

(51) Int. Cl.[7] ..... B65D 51/20; B65D 41/60; A61J 1/05

(52) U.S. Cl. ..... 215/249; 215/253; 215/251; 215/247; 215/250; 215/364; 215/305; 215/DIG. 3; 220/257.1; 220/266; 604/415

(58) Field of Search ..... 215/364, 247, 215/249, 251, 253, 320, 250, 254, 256, 305, DIG. 3; 220/266, 257.1, 265, 257.2; 604/415

(56) References Cited

U.S. PATENT DOCUMENTS 2,705,085 A * 3/1955 Glensky ..... 215/249
3,528,091 A * 9/1970 Sachau ..... 215/320
4,194,640 A * 3/1980 Crankshaw et al. ..... 215/320
4,244,478 A * 1/1981 Handman ..... 215/249
4,482,071 A * 11/1984 Ishiwatari ..... 215/255
4,844,267 A * 7/1989 von Schuckmann ..... 215/253
5,080,245 A * 1/1992 Conard ..... 215/249
5,405,031 A * 4/1995 Derksen ..... 215/249
5,447,247 A * 9/1995 Derksen ..... 215/249
5,555,988 A * 9/1996 Koch et al. ..... 215/249

FOREIGN PATENT DOCUMENTS

DE 3519655 A1 * 12/1986 ..... A61J/1/06
DE 4132896 1/1993
DE 4204427 7/1993
DE 4446182 A1 * 6/1996 ..... B65D/41/20
EP 0291658 11/1988

OTHER PUBLICATIONS

JP 09 164182 A (EISAI Co. Ltd.; Ishida Press Kogyo KK) Jun. 24, 1997.

* cited by examiner

*Primary Examiner*—Lee Young
*Assistant Examiner*—James Smalley
(74) *Attorney, Agent, or Firm*—Martin A. Farber

(57) ABSTRACT

The invention relates to a closing cap for infusion and transfusion bottles. The inventive cap is provided with a flanged cap which encompasses a flanged neck of the bottle, secures a closing plug in the bottle and is provided with a middle recess that is closed by the middle region of a plastic lid in such a way that a ring zone (21) of the plastic lid (2) supports the edge of the middle recess from behind. At least one radially extending desired folding line (I) of the plastic lid (2) is embodied. Said line is formed by thinning the material. The aim of the invention is to indicate when said cap has been used. In an advantageous embodiment, the desired folding line (I) opens into a circumferential weakened area (S) that extends at a radial distance (y) from the center (z) of the plastic lid (2).

20 Claims, 7 Drawing Sheets

CLOSING CAP FOR INFUSION AND TRANSFUSION BOTTLES

FIELD AND BACKGROUND OF THE INVENTION

The invention relates to a closure cap for infusion and transfusion bottles, having a flanged cap, which engages around a flanged neck of the bottle, secures a closure stopper in the bottle and has a center recess, which is closed off by the center region of a plastic cover in such a manner that an annular zone of the plastic cover engages beneath the edge of the center recess, in which closure cap at least one desired bending line of the plastic cover, which is formed by a thinning of the material and runs in the radial direction, is formed.

A closure cap of this type is known from EP 0 291 658 A1. The desired bending line, which in that document runs in the radial direction, by way of example, makes it easier to remove the plastic cover, which as an upper cap engages protectively over the generally metallic flanged cap. A puncture region of the closure stopper then becomes accessible to a cannula or spike via the center recess of this cap which is then uncovered. According to one embodiment of the abovementioned forerunner, the radial desired bending line, which is produced as a groove, continues as a radial aperture into the wall of the cap-like plastic cover. The aperture opens up at the end side of the plastic-cover edge.

SUMMARY OF THE INVENTION

Working on the basis of these previous documents, the invention is based on the object of advantageously forming a closure cap of the generic type with regard to the aspect of indicating use.

This object is achieved by providing that the desired bending line opens out into a circumferential weakening which runs at a radial distance from the center point of the plastic cover.

A configuration of this type produces a closure cap of the generic type with an increased level of security. Use leaves behind clear indications. Reuse of the closure cap for tampering purposes is virtually ruled out. Protection against tampering with medicaments of this type is becoming increasingly important. The construction according to the invention leads to a bending characteristic which goes as far as breaking. The circumferential weakening which runs around a center point not only leads to a breaking crack with regard to the desired bending lines, but also to a white breakage indicator in the plastic cover, on account of the stipulated geometrically arched bending axis, which, however, in reality develops transversely to the upward folding direction of the bent part of the plastic cover. The visible feature is retained. The desired effect is further enhanced by the fact that the radially running desired bending line continues, on the outer edge side, into an axial weakening of the plastic cover, the desired bending line being formed into the axial inner surface of the plastic cover. This axially oriented weakening occurs as an additional breaking crack. Forming the weakening at the inner surface makes the corresponding tamper-proofing means virtually invisible from the outside. On the other hand, the breaking crack occurs as soon as it is attempted to open the cap. Furthermore, the invention proposes that the material thinning is greater in the region of the desired bending lines than in the circumferential weakening. This has advantages with regard to easier opening of the bottle, i.e. bending out the plastic cover from the periphery. It is then provided that the circumferential weakening is a groove which is U-shaped as seen in cross section. This creates a type of annular trench. Its width can be selected such that the bending axis is accommodated as a chord therein. With regard to the crack formation, it has proven advantageous for the radial desired bending line to be formed as a recess which is V-shaped as seen in cross section. This forms a notched valley which aids separation. A refining feature of the invention results from the fact that the valley bottom of the V-recess is lower than the bottom of the circumferential weakening. In this way, the breaking crack and the white break can be achieved with unambiguously separate actions. Specifically, the refinement in this context is such that the wall thickness of the plastic cover which is taken up by the desired bending line is greater on the radially outer side than on the radially inner side. In other words: higher V-flanks are achieved on the outer side. Good support, which extends virtually as far as close to the center recess of the flanged cap, for the plastic cover is in this case ensured by the fact that the greater wall thickness of the plastic cover which is taken up by the desired bending line continues from the radially outer side, distributed over the circumference, into ribs which rise in a height-compensating manner in the region of lesser wall thickness and extend as far as the circumferential weakening. The ribs are advantageously formed so as to run in the angle bisector of the desired bending lines. They ideally lie at a spacing from six desired bending lines, or the V recesses which form them, which are disposed-distributed at equal angles. A configuration which is even of independent importance is achieved, on a closure which furthermore in the central region of the plastic cover, on the underside, forms an annular collar as annular zone, for supporting the flanged cap of the center recess, in that the annular collar continues into grip-under tongues which engage under the flanged cap. A ring of grip-under tongues of this type can be thermally spread and in this way can be securely anchored to the flanged cap. Finally, it is provided that the grip-under tongues become detached from the flanged cap, without bringing the flanged cap with them, when the plastic cover is torn off. Since the grip-under tongues are resilient on account of the restoring action of the material of the plastic cover, the result is that the original spread-out position is restored more or less precisely, but this makes it very difficult or even impossible for the grip-under tongues to be "threaded back in", passing through the center recess. This security effect is also of importance.

BRIEF DESCRIPTION OF THE DRAWINGS

The subject matter of the invention is explained in more detail below with reference to an exemplary embodiment illustrated in the drawing, in which.

DETAILED DESCRIPTION OF THE PREFERRED EMBODIMENT

Figure 1:
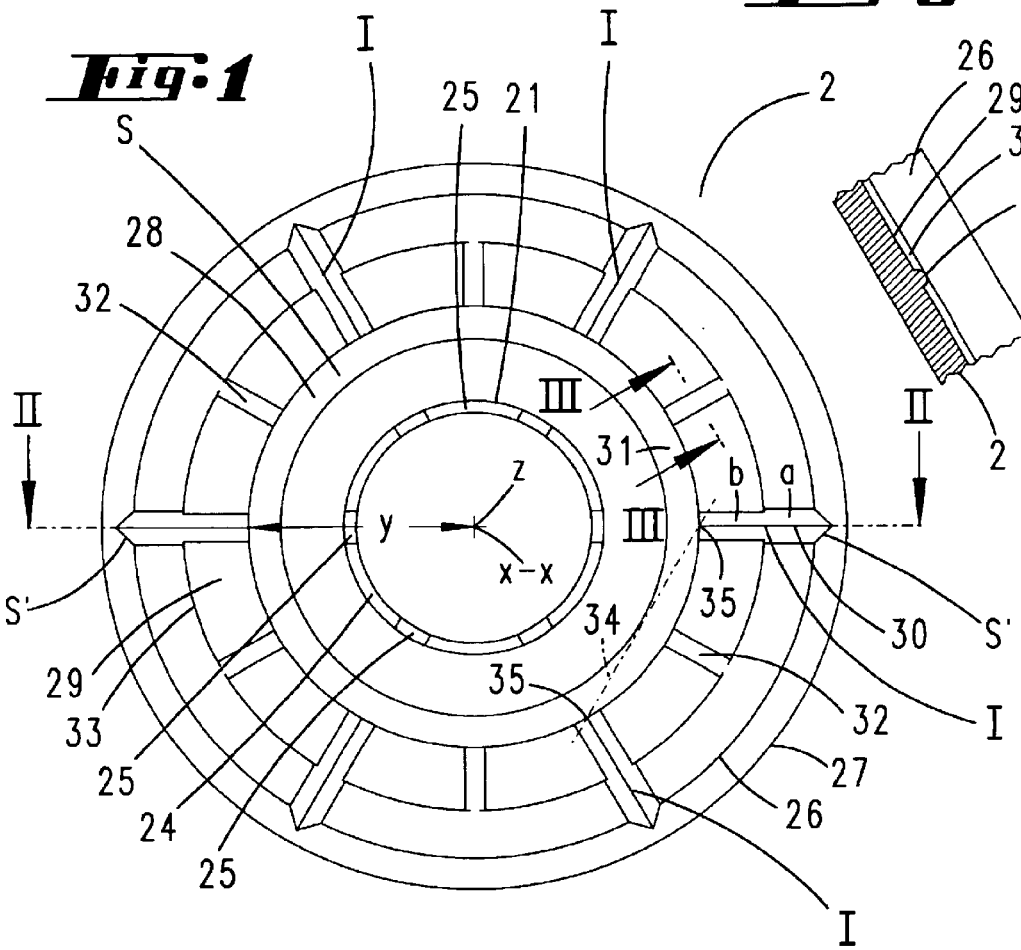
FIG. 1 shows a greatly enlarged view of the plastic cover of the closure cap from below.

The closure cap 1 illustrated comprises a covering plastic cover 2 with a metallic flanged cap 3 below it.

The flanged cap 3, which accommodates the plastic cover 2 straddling it, is flanged on a bead 4 of the flanged neck 5 of a bottle 6, for example an infusion bottle. The flanged rim bears the reference 7. The flanged-cap rim edge which engages over it is denoted by 3'.

The bottle 6 consists, for example, of glass.

Plastically deformable aluminum is expediently used for the metallic flanged cap 3.

A closure stopper 8 is then part of the closure cap 1. This is a hollow stopper. It is seated in a sealing manner in an opening 9 in the flanged neck 5 of the bottle 6.

The opening of a cavity 10 in the closure stopper 8 faces the interior 11 of the bottle 6. The cavity 10 lies in the section which forms the actual stopper and, as can be seen, ends flush with a horizontal end face 12 of the bead 4 of the flanged neck 5. An annular flange 13, which is formed on the periphery in the upper region of the closure stopper 8, and which, by means of the associated flanged cap 3, is pressed in a fixed and therefore sealing manner against the end face 12, engages over the said end face 12.

Figure 9:
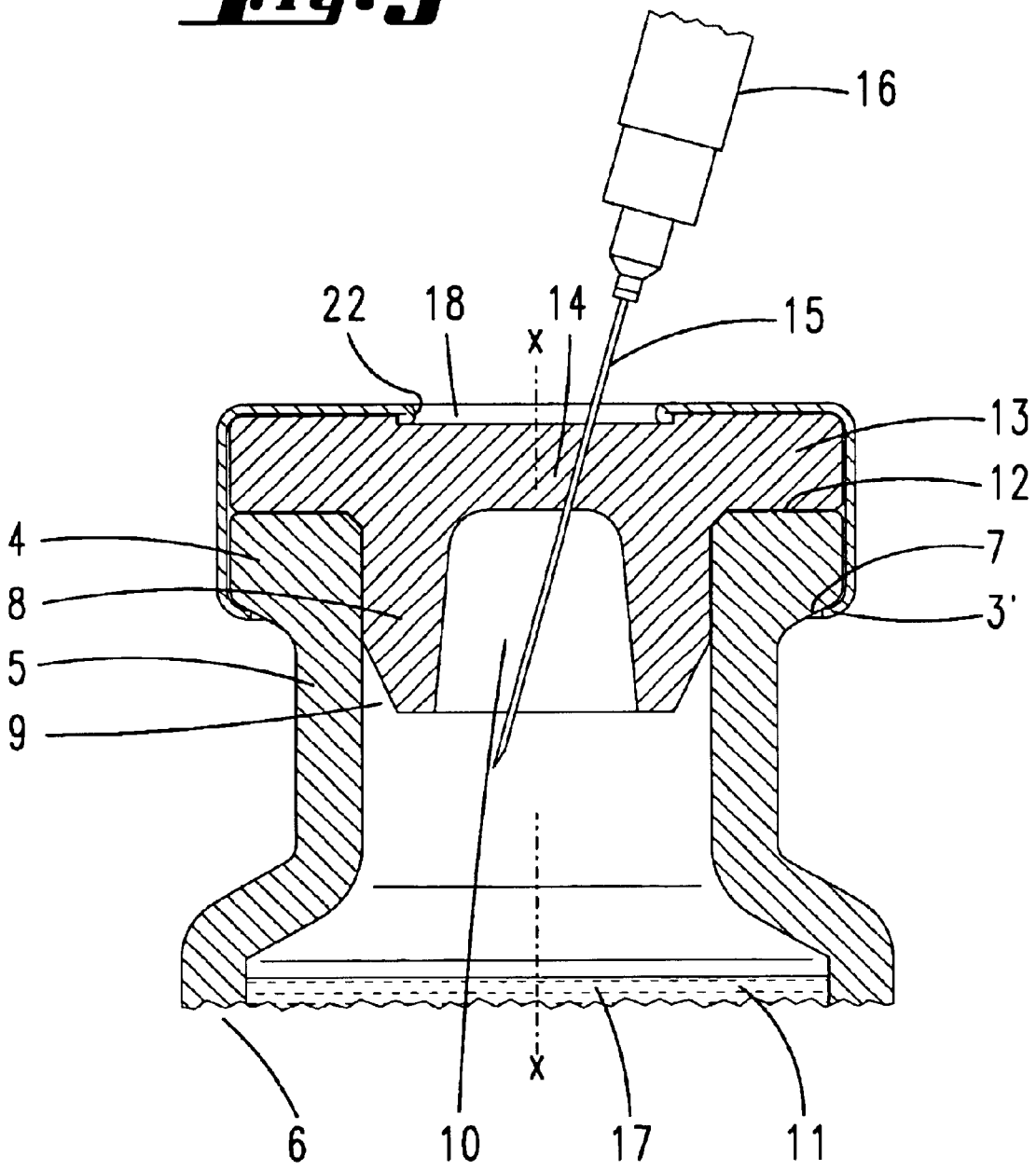
FIG. 9 shows this situation, illustrating the removal of the contents, for example a medicament (for this purpose, it goes without saying that the bottle is positioned with the neck directed downward)
Figure 10:
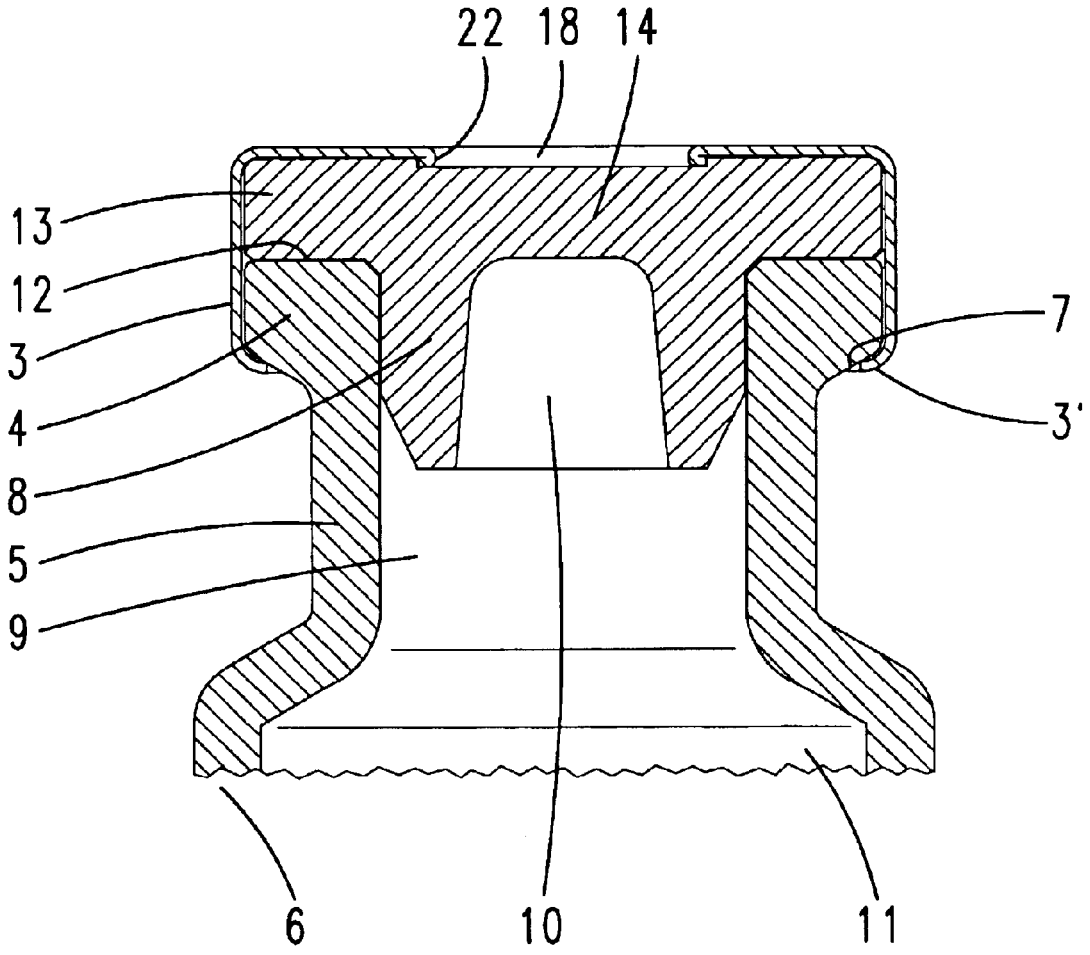
FIG. 10 shows the bottle in the state in which it is ready for disposal.

The closure stopper 8 is produced as a puncturable closure body. It consists of elastomeric material, such as for example butyl rubber. The puncturing is made easier by the cavity 10. The resulting thin-walled zone of the closure stopper 8 is marked by a puncture region 14. The cannula 15 of a syringe 16, which can be seen from FIG. 9, can be regarded as a puncturing tool. On the other hand, the removal of the contents of the liquid 17 illustrated by dashed lines in that figure can also take place via the infusion kit, usually with the infusion bottle or transfusion bottle suspended with the neck directed downward. The spike for this purpose is not illustrated.

To uncover the centrally located puncture region 14, it is necessary to have access to the closure stopper 8 disposed beneath the flanged cap 3. Access is provided by a center recess 18 in the top part of the flanged cap 3. The center recess 18 is kept closed by the center region 19, which lies above it, of the plastic cover 2 which extends over the entire upper side of the flanged cap 3.

An annular zone 21, which starts from the inner side of the top 20 of the plastic cover 2, projects into the center recess 18. The annular zone 21 comes into contact, in a position-centring manner, with an edge 22, which has been flanged over, thus losing its sharpness, of the center recess 18.

Starting from the plane of the top 20, the annular zone 21 has a projecting height which approximately corresponds to the thickness of the material of the flanged cap 3.

The edge 22, which is flanged by being folded downward, projects into a central depression 23 at the upper side of the closure stopper 8. The depression 23 is such that grip-under tongues 24, which anchor the plastic cover 2 to the flanged cap 3, are also accommodated therein.

Said grip-under tongues 24 start from an annular collar produced as annular zone 21. In the demolded state, they are produced as a row of teeth which substantially adopt an imaginary cylindrical profile (cf. FIGS. 1 and 2). The grip-under tongues 24, which accordingly were originally axially oriented, are interrupted by gaps 25. There are a total of six grip-under tongues 24, each-of the same width, and narrower gaps 25 compared to the circumferential length of the grip-under tongues 24. The ratio of gaps to tongues is between 1:2 and 1:5, and is preferably 1:3.

The grip-under tongues 24 can easily be opened out, creating good prior conditions for thermally/mechanically effected spreading for them to grip under in a directional manner.

Figure 6:
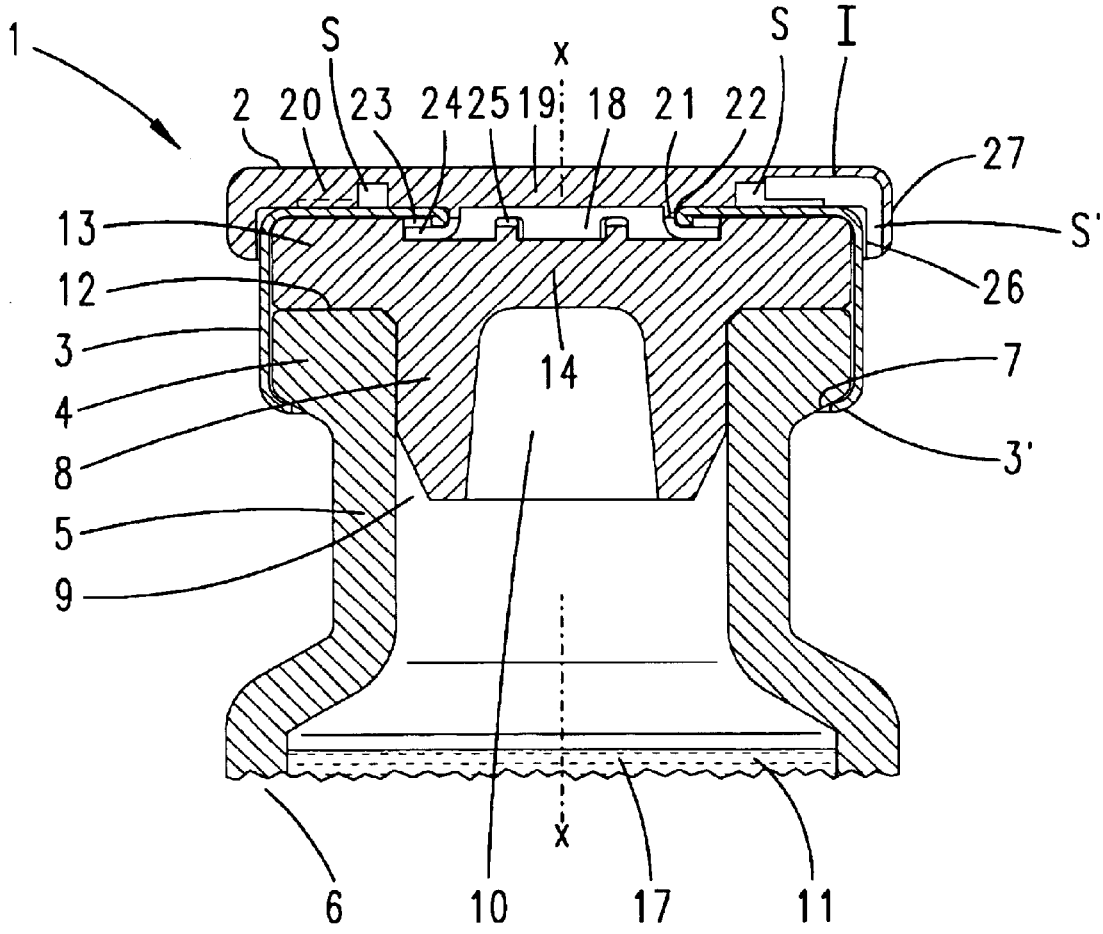
FIG. 6 shows a bottle provided with the closure cap according to the invention, in vertical section and in the closed state.

The anchoring situation described is clearly revealed by FIGS. 6*ff*.

Closure cap 1 and bottle 6 are of rotationally symmetrical structure. The longitudinal center axis in this respect bears reference symbols x—x.

The plastic cover 2 has radially running desired bending lines I. These are located on the inner side of the top 20 of the plastic cover 2 and are center-oriented. Said desired bending lines I are produced by material thinning during the injection-molding of the plastic cover 2.

As can be seen clearly in particular from FIG. 1, the desired bending lines I are produced so that they start at a clear radial distance y from a center point z of the plastic cover 2. This distance y corresponds to approximately half the radius of the shallow dish-shaped plastic cover 2. The material thinning ends, centrally oriented, in a circumferential weakening S which runs concentrically with respect to the center point z of the plastic cover 2 and into which it opens out. On the peripheral side, the desired bending lines I end close to the edge.

Figure 3:
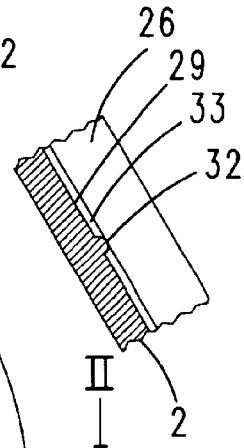
FIG. 3 shows the section on line III—III in FIG. 1.
Figure 2:
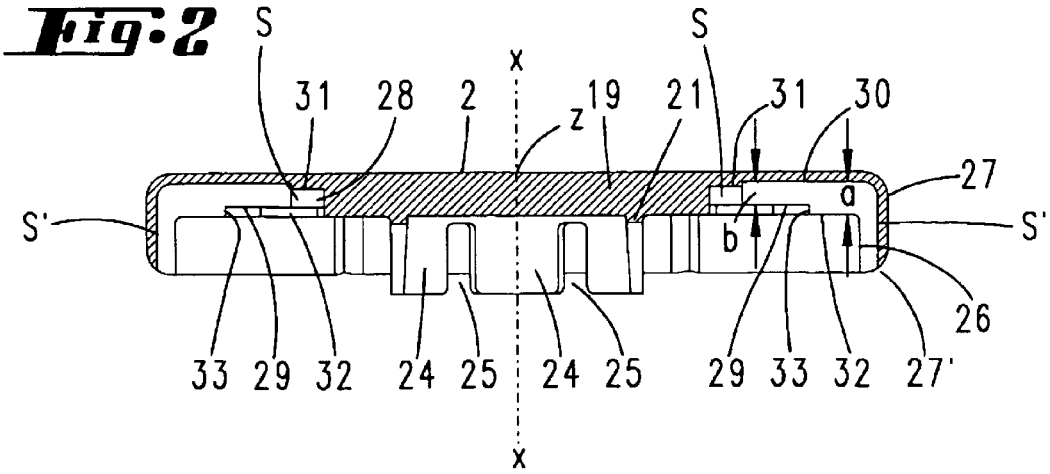
FIG. 2 shows the section on line II—II in FIG. 1.
Figure 5:
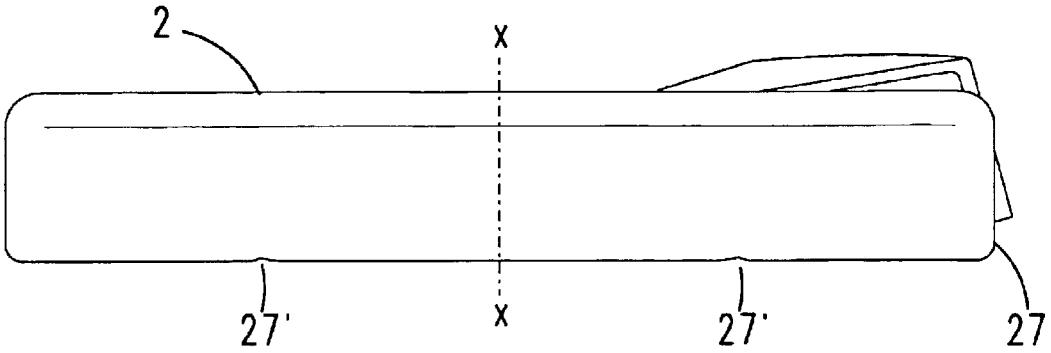
FIG. 5 shows a side view of this.

As can be seen from FIG. 2, the radially running desired bending lines 1 continue on the outer edge side into an axial weakening S' of the plastic cover 2. Going beyond the inner corner, the desired bending line I continues into the axial inner surface 26 of the cylindrical cap wall 27 of the plastic cover 2. The corresponding formation, which covers 90°, is clearly apparent from FIG. 3.

The radially oriented desired bending line I is configured as a recess which is V shaped as seen in cross section. The recess is formed from notched valleys which, in terms of cross section, peripherally adjoin the axial weakening S', which is profiled in the same way, in the inner surface 26 of the cap wall 27. As seen in cross section, the same V-shaped recess, i.e. a notched valley, is present. The latter is of a depth which is such that only a rudimentary wall thickness—approximately one third—remains and this can be opened by means of a breaking crack using moderate force. In the same way as the V-shaped recess is hidden from sight from the underside of the top 20 when the plastic cover 2 is secured in place, the V-shaped recess forming the weakening S' is also virtually invisible from the outside.

The circumferential weakening S, which is in the form of a circular ring and is produced as an annular trench, is based on a different cross section, namely a U-shaped groove. The depth of this groove covers a good two thirds of the basic thickness of the top 20.

The V-shaped recesses of the desired bending lines I are radial penetrations of a step 29 which precedes the circumferential weakening S on the radially outer side.

Accordingly, the material thinning in the region of the desired bending lines I is greater than in the circumferential weakening S. This is because, as can be seen, the valley bottom 30 of the V-shaped recess of the desired bending line I is deeper than the valley 31 of the circular circumferential weakening S. This means that a thinner residual wall of top 20 remains above the valley bottom 30 than above the bottom 31 of the annular trench. The latter is more stable as a result of an (albeit small) accumulation of material, while the former zone can be torn into more easily.

The corresponding ratios are particularly evident from FIG. 2. This illustration also makes it clear that the wall thickness of the plastic cover 2 which is taken up by the desired bending line I is greater on the radially outer side than on the radially inner side. On the radially outer side, the V-flanks of the V-shaped recess have a greater vertical height a than the height b measured in this direction in the region of the step 29.

Directed peripherally outward, beyond the step 29, there is the basic thickness of the top 20 of the plastic cover.

However, in the region of the step 29 there is an at least partial height compensation in this respect. This is embodied by the fact that ribs 32 which compensate for steps are formed. The details in this respect are such that the greater wall thickness of the plastic cover 2 which is taken up by the V-shaped recess of the desired bending line I continues, from the radially outer side, distributed over the circumference, into the ribs 32, which rise up in a height-compensating manner in the region of reduced wall thickness and extend as far as the circumferential weakening S which is in the shape of a circular ring, i.e. as far as the groove 28.

The radially oriented ribs 32 which are fixed to the step jump 33 lie so as to run in the angle bisector of respectively adjacent desired bending lines I. Overall, six desired bending lines I which are disposed distributed at equal angles are formed.

Figure 7:
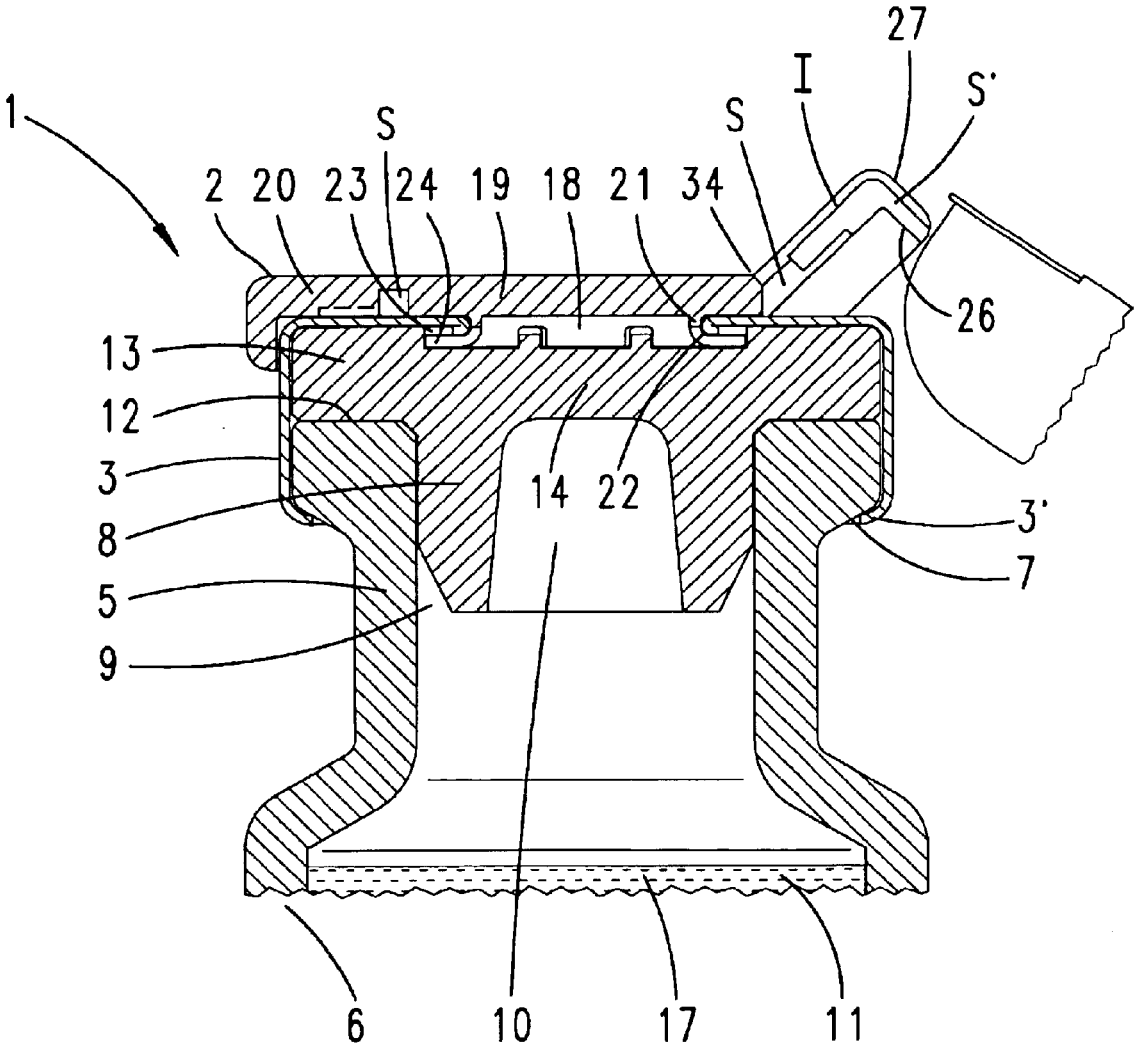
FIG. 7 shows an illustration corresponding to FIG. 6 during the bending up of an edge part of the plastic cover.
Figure 8:
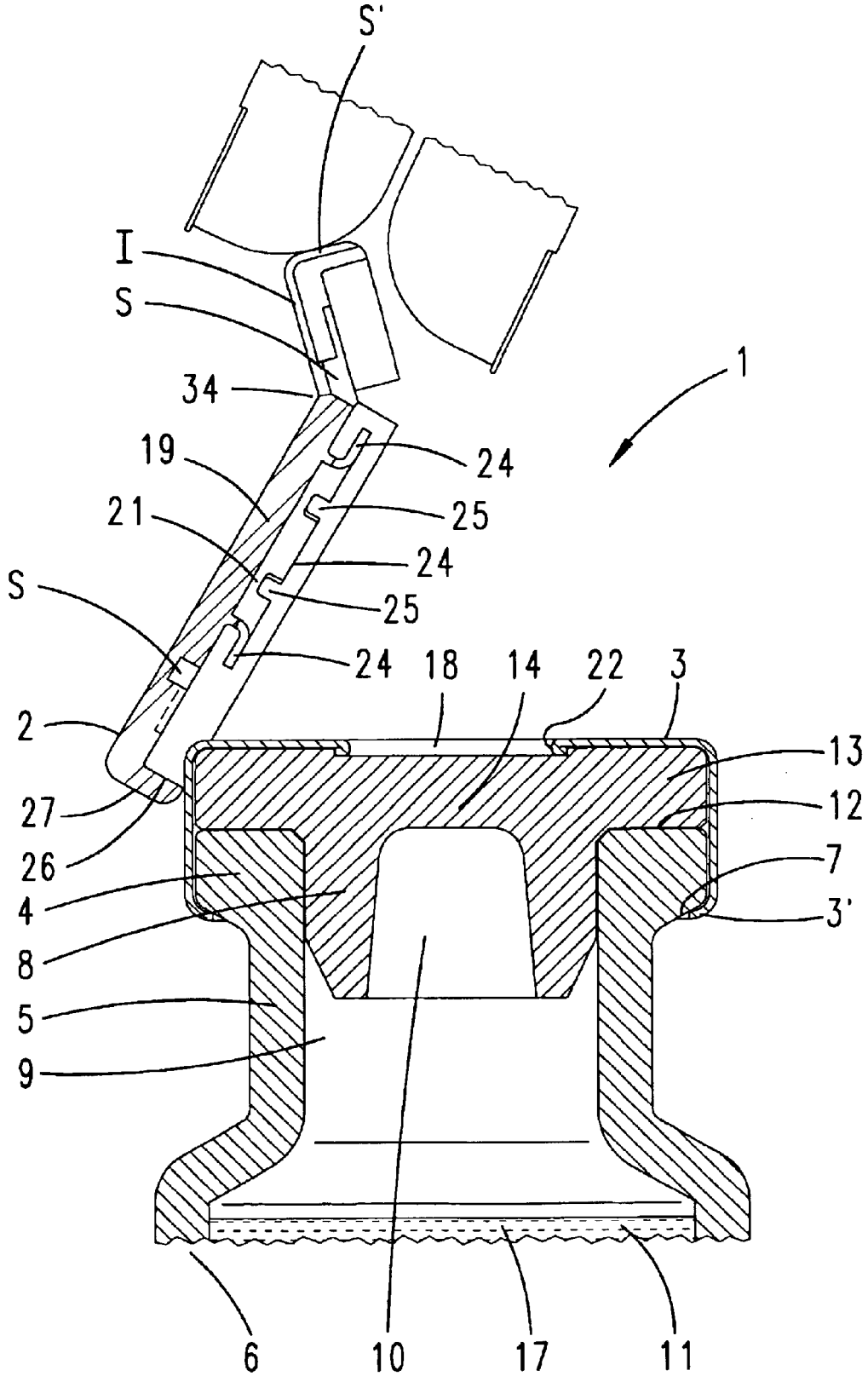
FIG. 8 shows an illustration corresponding to FIG. 6, but now with the plastic cover completely lifted off.

To uncover the centrally located puncture region 14 of the closure stopper 8, the cap edge of the plastic cover 2 is gripped from below and bent upward as shown in FIG. 7. This leads to a breaking crack in the region of the lateral wall of the cap wall 27. The breaking crack continues beyond the corner to the top 20 into the centrally oriented desired bending lines I of adjacent V-shaped recesses. The upward bending results in a relatively large sectoral grip tongue. There may also be two or more of these. The sectoral grip tongue which has been moved makes it easier to tear off the plastic cover 2 as a whole. Reference is made to FIG. 8. In the case of two adjacent grip tongues, the crack edges even increasingly go beyond one another in the manner of scissors. The breaking crack or cracks are also introduced with accurate lines, since the ridges of the V-shaped recesses in the end-side edge rounding of the cap wall 27 form small V-indents 27'. This is precisely where the crack will begin.

When the plastic cover 2 is being torn off, the grip-under tongues 24 become detached from their anchoring region. They are pulled under the edge 22 of the center recess 18.

By means of radially oriented cross-ribbing, strips can project from the base of the indentation 23 into the gaps 25, so that with regard to the gripping-under action of the grip-under tongues 24 it is possible to speak of a pocketed effect.

Figure 4:
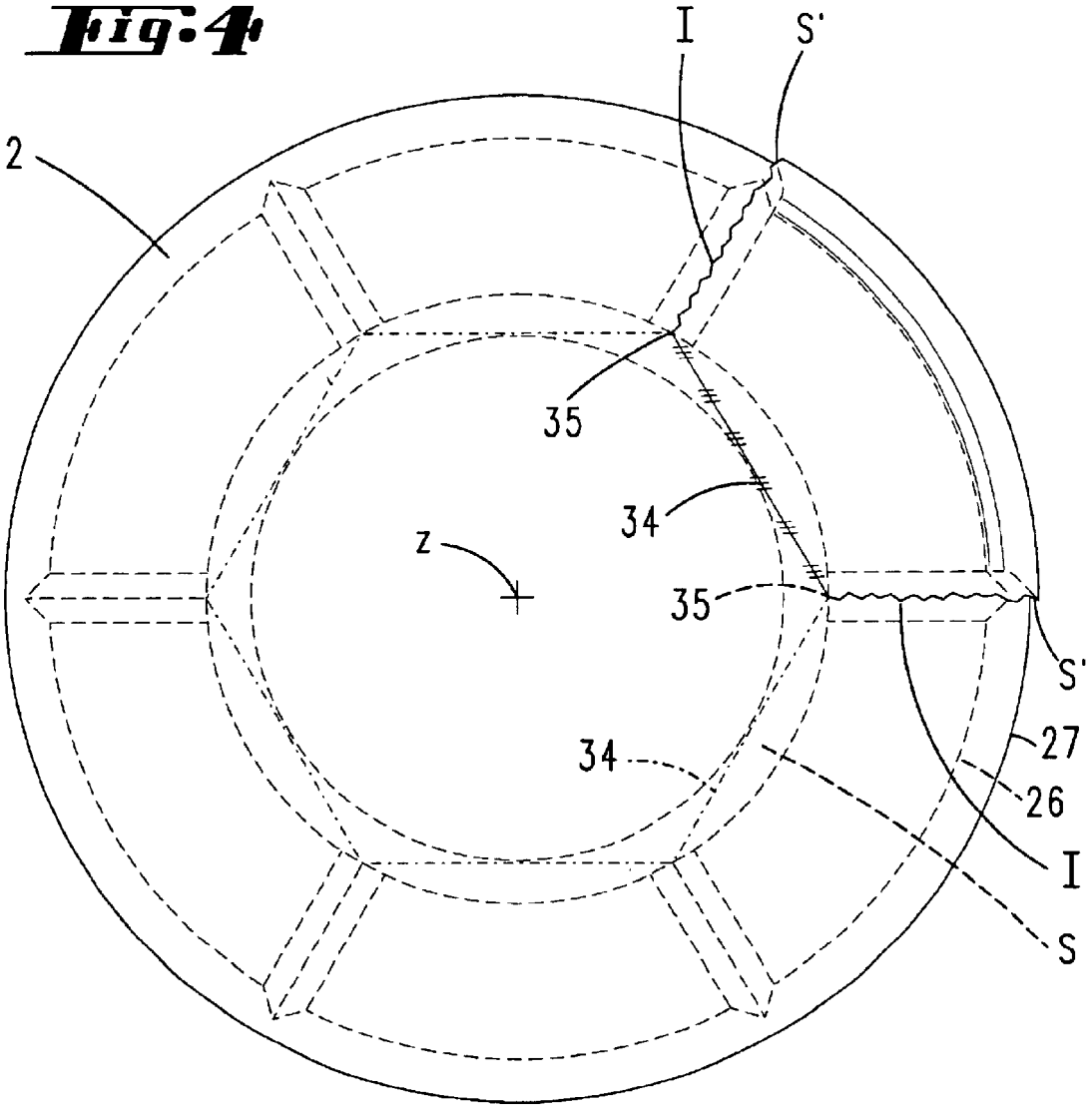
FIG. 4 shows the plan view of the closure cap, representing an opening phase which is initiated from the periphery.

With regard to the breaking cracks leaving clear traces along the radially running desired bending lines I and the axial weakening S', on the radially outer side a sectoral removal of the cover part, i.e. of the said grip tab, occurs, while on the upper side of the bottom 31 of the circumferential weakening S, a white breaking line 34 is formed. This appears as a chord within the radial dimension of the sufficiently wide annular trench of the U-shaped groove 28. Reference is made to FIG. 4. There, the breaking cracks end flush with the outer flank of the U-shaped groove 28, while the white breaking line 34, as has already been stated, is a chord which is tangent more on the flank of the U-shaped groove 28 which lies further inward, flush with it in terms of its plane. The white breaking line 34 forms the geometric axis of the sector which has been folded upward. The end of the extended white breaking line 34 is defined by the groove-side exit ends 35 of the desired bending lines I, which are structurally formed by the V-shaped recesses.

The cover breaking, as illustrated in FIG. 4, can also serve to destroy a logo which has been applied, thus also preventing the closure from being reused with regard to this optical-visual aspect.

All features disclosed are (inherently) pertinent to the invention. The disclosure content of the associated/appended priority documents (copy of the prior application) is hereby incorporated in its entirety in the disclosure of the application, partly for the purpose of incorporating features of these documents in claims of the present application.

What is claimed is:

1. A closure cap (1) for an infusion and transfusion bottle, having a flanged cap (3), which engages around a flanged neck (5) of the bottle (6), secures a closure stopper (8) in the bottle (6) arid has a center recess (18), which is closed off by a center region (19) of a plastic cover (2) such that an annular zone (21) of the plastic cover (2) engages beneath an edge (22) of the center recess (18), in said closure cap at least two desired bending lines (I) of the plastic cover are formed by a thinning of the material and run in radial direction and wherein the desired bending lines (I) open out into a circumferential weakening (S) which runs at a radial distance (y) from a center point (z) of the plastic cover (2).

2. The closure cap according to claim 1, wherein the radially running desired bending lines (I) continue, on an outer edge side, into an axial weakening (S') of the plastic cover (2), the desired bending lines (I) being formed into an axial inner surface (26) of the plastic cover (2).

3. The closure cap according to claim 1, wherein the material thinning is greater in the region of the desired bending lines (I) than in the circumferential weakening (S).

4. The closure cap according to claim 1, wherein the circumferential weakening (S) is a groove (28) which is U-shaped in cross section.

5. The closure cap according to claim 1, wherein the radially running desired bending lines (I) are formed each as a recess which is V-shaped in cross section.

6. The closure cap according to claim 5, wherein a valley bottom (30) of the V-shaped recess is lower than a bottom (31) of the circumferential weakening (S).

7. The closure cap according to claim 1, wherein a wall thickness of the plastic cover (2) along an individual one of the desired bending lines (I) is greater on a radially outer side of the plastic cover than on a radially inner side of the plastic cover.

8. The closure cap according to claim 7, wherein a greater wall thickness of the plastic cover (2) along an individual one of the desired bending lines (I) continues from the radially outer side, distributed over a circumference, into ribs (32) which rise to compensate for the difference in height in a region of a lesser wall thickness and extend as far as the circumferential weakening (S).

9. The closure cap according to claim 8, wherein the ribs (32) run in an angle bisector of the desired bending lines (I).

10. The closure cap according to claim 1, wherein there are six of said desired bending lines (I) which are disposed distributed at equal angles.

11. The closure cap according to claim 1, wherein, in a central region of the plastic cover (2), an annular collar is formed on an underside as annular zone (21) to support the flanged cap (3) from a center recess (18) wherein the annular collar continues into grip-under tongues (24) which engage under the flanged cap (3).

12. The closure according to claim 11, wherein the grip-under tongues (24) become detached from the flanged cap (3), without bringing the flanged cap (3) with them, when the plastic cover (2) is torn off.

13. The closure according to claim 1, wherein the circumferential bending lines are radially outside from the annular zone of the plastic cover engaging beneath the edge of the center recess.

14. A closure cap (1) for an infusion and transfusion bottle, having a flanged cap (3), which engages around a flanged neck (5) of the bottle (6), secures a closure stopper (8) in the bottle (6) and has a center recess (18), which is closed off by a center region (19) of a plastic cover (2) such that an annular zone (21) of the plastic cover (2) engages beneath an edge (22) of the center recess (18), wherein in said closure cap at least two desired bending lines (I) of the plastic cover are formed by a thinning of the material and runs in radial direction, and wherein the desired bending lines (I) open out into a circumferential weakening (S) which runs at a radial distance (y) from a center point (z) of the plastic cover (2), wherein the circumferential weakening (S) is a groove (28) which is U-shaped in cross section.

15. A closure cap (1) for an infusion and transfusion bottle, having a flanged cap (3), which engages around a flanged neck (5) of the bottle (6), secures a closure stopper (8) in the bottle (6) and has a center recess (18), which is closed off by a center region (19) of a plastic cover (2) such that an annular zone (21) of the plastic cover (2) engages beneath an edge (22) of the center recess (18), wherein, in said closure cap at least two desired bending lines (I) of the plastic cover are formed by a thinning of the material and run in radial direction and wherein the desired bending lines (I) open out into a circumferential weakening (S) which runs at a radial distance (y) from a center point (z) of the plastic cover (2), wherein each of the radially running desired bending lines (I) is formed an a recess which is V-shaped in cross section.

16. The closure cap according to claim 15, wherein a valley bottom (30) of the V-shaped recess is lower than a bottom (31) of the circumferential weakening (S).

17. A closure cap (1) for an infusion and transfusion bottle, having a flanged cap (3), which engages around a flanged neck (5) of the bottle (6), secures a closure stopper (8) in the bottle (6) and has a center recess (18), which is closed off by a center region (19) of a plastic cover (2) such that an annular zone (21) of the plastic cover (2) engages beneath an edge (22) of the center recess (18), wherein, in said closure cap at least two desired bending lines (I) of the plastic cover are formed by a thinning of the material and run in radial direction and wherein the desired bending lines (I) open out into a circumferential weakening (S) which runs at a radial distance (y) from a center point (z) of the plastic cover (2), wherein a wall thickness of the plastic cover (2) along an individual one of the desired bending lines (I) is greater on a radially outer side of the plastic cover than on a radially inner side of the plastic cover.

18. The closure cap according to claim 17, wherein a greater wall thickness of the plastic cover (2) along an individual one of the desired bending lines (I) continues from the radially outer side, distributed over a circumference, into ribs (32) which rise to compensate for the difference in height in a region of a lesser wall thickness and extend as far as the circumferential weakening (S).

19. The closure cap according to claim 18, wherein the ribs (32) run in an angle bisector of the desired bending lines (I).

20. A closure cap (1) for an infusion and transfusion bottle, having a flanged cap (3), which engages around a flanged neck (5) of the bottle (6), secures a closure stopper (8) in the bottle (6) and has a center recess (18), which is closed off by a center region (19) of a plastic cover (2) such that an annular zone (21) of the plastic cover (2) engages beneath an edge (22) of the center recess (18), wherein, in said closure cap at least two desired bending lines (I) of the plastic cover are formed by a thinning of the material and runs in radial direction and wherein the desired bending lines (I) open out into a circumferential weakening (S) which runs at a radial distance (y) from a center point (z) of the plastic cover (2), wherein there are six of said desired bending lines (I) which are disposed distributed at equal angles.

* * * * *